US008365840B2

(12) United States Patent
Sinnerstad et al.

(10) Patent No.: US 8,365,840 B2
(45) Date of Patent: Feb. 5, 2013

(54) METHOD AND DEVICE FOR CONTROLLING AT LEAST ONE DRILLING PARAMETER FOR ROCK DRILLING

(75) Inventors: Jonas Sinnerstad, Örebro (SE); Magnus Olsson, Hallsberg (SE); Marcus Leü, Fjugesta (SE)

(73) Assignee: Atlas Copco Rock Drills AB, Orebro (SE)

( * ) Notice: Subject to any disclaimer, the term of this patent is extended or adjusted under 35 U.S.C. 154(b) by 399 days.

(21) Appl. No.: 12/450,686

(22) PCT Filed: Apr. 9, 2008

(86) PCT No.: PCT/SE2008/000256

§ 371 (c)(1), (2), (4) Date: Oct. 6, 2009

(87) PCT Pub. No.: WO2008/127172

PCT Pub. Date: Oct. 23, 2008

(65) Prior Publication Data

US 2010/0059278 A1 Mar. 11, 2010

(30) Foreign Application Priority Data

Apr. 11, 2007 (SE) ..... 0700884

(51) Int. Cl.
*E21B 44/00* (2006.01)
*E21B 7/24* (2006.01)

(52) U.S. Cl. ..... 175/24; 175/56

(58) Field of Classification Search ..... 173/1, 4, 173/10, 11, 210, 212; 175/24, 56, 135, 26
See application file for complete search history.

(56) References Cited

U.S. PATENT DOCUMENTS

| | | | | |
|---|---|---|---|---|
| 4,246,973 | A * | 1/1981 | Mayer | 173/8 |
| 5,479,996 | A * | 1/1996 | Jonsson et al. | 175/135 |
| 5,896,937 | A * | 4/1999 | Kaneko | 173/211 |
| 6,112,832 | A * | 9/2000 | Muuttonen et al. | 175/40 |
| 6,273,199 | B1 * | 8/2001 | Kiikka et al. | 173/1 |
| 6,318,478 | B1 * | 11/2001 | Kaneko | 173/4 |
| 6,877,569 | B2 * | 4/2005 | Koskimaki | 173/1 |
| 7,654,337 | B2 * | 2/2010 | Noel | 173/1 |
| 8,051,926 | B2 * | 11/2011 | Weddfelt | 175/293 |

(Continued)

FOREIGN PATENT DOCUMENTS

| | | |
|---|---|---|
| DE | 4302755 A1 | 8/1994 |
| EP | 0648915 A1 | 4/1995 |

(Continued)

*Primary Examiner* — Giovanna Wright
*Assistant Examiner* — Michael Wills, III
(74) *Attorney, Agent, or Firm* — Mark P. Stone

(57) ABSTRACT

The present invention relates to a method and a device for controlling at least one drill parameter when drilling in rock with a drilling machine. During drilling, an impulse-generating device uses an impact means to induce shock waves in a tool working against the rock, a pressure level for a shock-wave-generating pressure is controlled during the drilling, and said drilling machine includes a damping chamber that can be pressurized. The contact of the drilling machine against the rock is affected at least partially by the pressure prevailing in said damping chamber. When the pressure in said damping chamber exceeds said first level and is below said second level, the percussion pressure is controlled as a function of the pressure in said damping chamber.

20 Claims, 5 Drawing Sheets

U.S. PATENT DOCUMENTS

| | | | | |
|---|---|---|---|---|
| 2007/0209812 | A1* | 9/2007 | Jonsson | 173/1 |
| 2008/0060846 | A1* | 3/2008 | Belcher et al. | 175/25 |
| 2009/0044976 | A1* | 2/2009 | Pettersson | 175/24 |

FOREIGN PATENT DOCUMENTS

| | | | |
|---|---|---|---|
| EP | 1064123 | A1 | 1/2001 |
| WO | WO 97/49895 | | 12/1997 |
| WO | WO 01/33043 | A1 | 5/2001 |
| WO | WO 03/044319 | A1 | 5/2003 |
| WO | WO 2005/121506 | A1 | 12/2005 |
| WO | WO 2006/108918 | A1 | 10/2006 |

* cited by examiner

METHOD AND DEVICE FOR CONTROLLING AT LEAST ONE DRILLING PARAMETER FOR ROCK DRILLING

TECHNICAL FIELD

The present invention relates to a method and a device for controlling drill parameters when drilling in rock, as set forth in the preamble of Claims 1 and 6, respectively.

BACKGROUND OF THE INVENTION

Rock drilling is often carried out by percussion drilling, where a percussion piston, which is often operated hydraulically, is used to create a shock wave with the aid of an impact force that is generated by hydraulic pressure (percussion pressure), the shock wave being transmitted to the drill bit and hence to the rock through the drill steel (drill string). On contact with the rock, pins made of a hard alloy of the drill bit contacting the rock is pushed into the rock, generating a strong enough force to fragment the rock.

In rock drilling of this kind, it is important that the start of the drilling is performed correctly and that drilling is done with care during normal drilling (i.e.

drilling with high impact force) in order to ensure that the drilling takes place in a manner that does not damage the drilling machine/drilling rig.

It applies in general, and especially in the case of drilling under difficult rock conditions and with a strong impact force, that the drill bit should have as good a contact with the rock as possible. A common way of achieving this is to use a piston which works against the drill steel (drill string) and which is usually in the form of a damping piston, which is also used to damp reflexes from the impact of the shock waves against the rock. During drilling, the damping piston is pressed against the drill steel, and the drill steel is thus pressed against the rock, by pressurization of a pressure chamber working against the damping piston. The damping piston is also usually arranged such that, if the damping piston advances too far, i.e. the area in front of the drill steel is soft enough for the impact of the percussion piston to cause the drill steel, and thus the damping piston, to move forwards and past a normal position, an outlet for said pressure chamber is completely or partially opened, resulting in a pressure decrease in the pressure chamber. By detecting this decrease in pressure, the status of the contact with the rock can be determined, and suitable measures can thus be taken.

For example, the percussion pressure can be increased to a normal drilling level when the damping pressure exceeds a defined pressure level, which, for example, can be a pressure level that has been determined as being desirable during normal drilling. Moreover, the percussion pressure can be arranged to be kept at the normal drilling level as long as the damping pressure does not fall below a low-pressure level, which, for example, can be a level that involves lost or poor contact with the rock. If the damping pressure falls below this level, the percussion pressure can be decreased to the start-up drilling level or can be completely shut off. However, this type of control has a number of disadvantages.

For example, there is a considerable risk of idle percussion, i.e. percussion where most of the shock wave is reflected in the drill bit instead of the rock, which leads to a large amount of damaging energy being returned to the drilling machine.

There is therefore a need for an improved method and device for controlling drill parameters, specifically a method and device that at least partially alleviate the problems of the prior art.

OBJECT OF THE INVENTION AND ITS MOST IMPORTANT FEATURES

One object of the present invention is to provide a method for controlling at least one drill parameter in order to solve the above problems.

Another object of the present invention is to provide a device for controlling at least one drill parameter in order to solve the above problems.

These and other objects are achieved, according to the present invention, by a method for controlling at least one drill parameter, as defined in Claim 1, and by a device according to Claim 6.

According to the present invention, the abovementioned aims are achieved by a method for controlling at least one drill parameter when drilling in rock with a drilling machine. During the drilling, an impulse-generating device, using an impact means, induce shock waves in a tool working against the rock, whereby a pressure level for a shock-wave-generating pressure is controlled during the drilling, and where said drilling machine includes a damping chamber that can be pressurized. The contact of the drilling machine against the rock is at least partially affected by the prevailing pressure in said damping chamber. The method includes the step in which, when the pressure in said damping chamber exceeds a first level and is below a second level, the percussion pressure is controlled as a function of the pressure in said damping chamber.

This has the advantage that, by controlling the percussion pressure as a function of the pressure in a damping chamber, it is possible to ensure in every situation that a correct percussion pressure is used in relation to the damping pressure. This in turn means that damaging reflexes can be avoided both during start-up drilling and during normal drilling.

In said control, the percussion pressure can, for example, be controlled between a first level, which substantially corresponds to a start-up drilling level, and a second level, which substantially corresponds to a normal drilling level.

The first level can, for example, substantially correspond to a level at which the percussion pressure is substantially shut off.

Said function can, for example, be one or a combination of several of the following: proportional to the damping pressure, inversely proportional to the damping pressure, exponential to the damping pressure, logarithmic to the damping pressure, a defined relationship to the damping pressure.

The control can, for example, be obtained with the aid of a mathematical relation between damping pressure and percussion pressure and/or by reference to a table containing a relationship between damping pressure and percussion pressure.

The method can further include the step in which, when the pressure in said damping chamber exceeds said second level, the percussion pressure is controlled in such a way that it is maintained substantially at a pressure corresponding to the percussion pressure for said second level.

The method can further include the step in which, when the pressure in said pressure chamber falls below said first level, the percussion pressure is controlled in such a way that it is maintained substantially at a pressure corresponding to the percussion pressure for said first level.

Said pressure in said damping chamber can be determined by determining a parameter value representing a mean value of the damping pressure in the damping chamber. The parameter value representing a mean value of the damping pressure in the damping chamber can, for example, be determined with the aid of the pressure in a pressure feed line for said damping chamber.

The damping pressure can, for example, be determined continuously and/or at certain intervals by sensoring, monitoring, measurement or calculation.

The mean value can, for example, be determined based on a plurality of impulse cycles.

The method can further include the step in which, when said damping pressure exceeds a third level higher than said second level, the percussion pressure is controlled as a function of said damping pressure, with said percussion pressure exceeding said second percussion pressure level.

The method can further include the step of controlling the percussion pressure in such a way that the time for an increase of said percussion pressure from the first level to the second level exceeds a threshold value.

The feed rate of the drilling machine can also be used in controlling the percussion pressure. In this case, the dependency of the percussion pressure on the damping pressure can be made to depend partly on the feed rate.

The present invention also relates to a device by means of which advantages corresponding to those described above are obtained with corresponding device features.

Other advantages are obtained by various aspects of the invention and will become clear from the following

DETAILED DESCRIPTION OF THE DRAWINGS

DETAILED DESCRIPTION OF PREFERRED EMBODIMENTS

Figure 1:
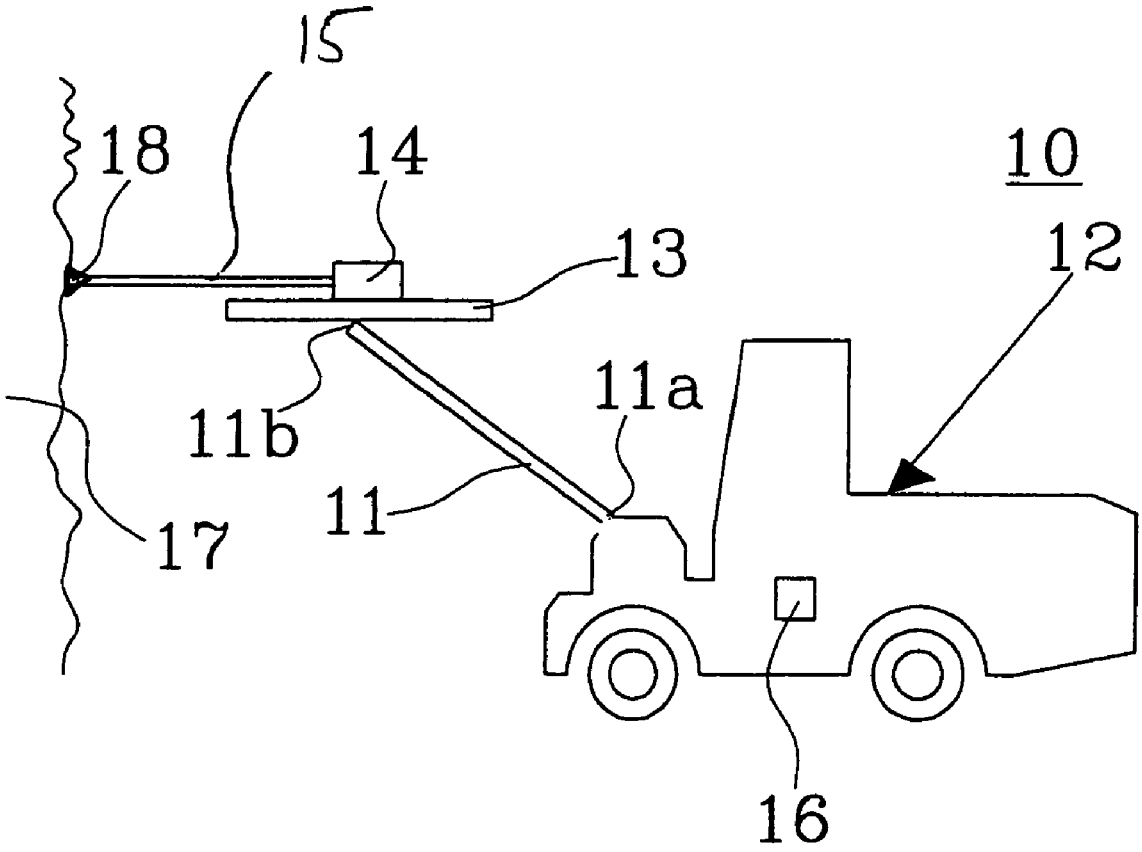
FIG. 1 shows an example of a drilling rig in which the present invention can be used.

The present invention will now be explained by way of example with reference to a rock-drilling rig of the type shown in FIG. 1. FIG. 1 shows a rock-drilling rig 10 for tunnelling, for ore mining, or for installing rock reinforcement bolts in the case of, for example, tunnelling or mining. The drilling rig 10 comprises a boom 11, one end 11*a* of which being articulately connected to a carrier 12, such as a vehicle, via one or more joints, while the other end 11*b* has a feed beam 13 that supports an impulse-generating device in the form of a drilling machine 14. The drilling machine 14 is displaceable along the feed beam 13 and generates shock waves that are conveyed to the rock 17 via a drill string 15 and a drill bit 18. The rig 10 also comprises a control unit 16 which can be used to control drill parameters in accordance with the present invention, and in the manner described below. The control unit 16 can be used to monitor the position, direction, drilled distance, etc., with regard to the drilling machine and carrier. The control unit 16 can also be used to control the movement of the rig 10, although a separate control unit can of course also be used for this purpose.

Figure 2:
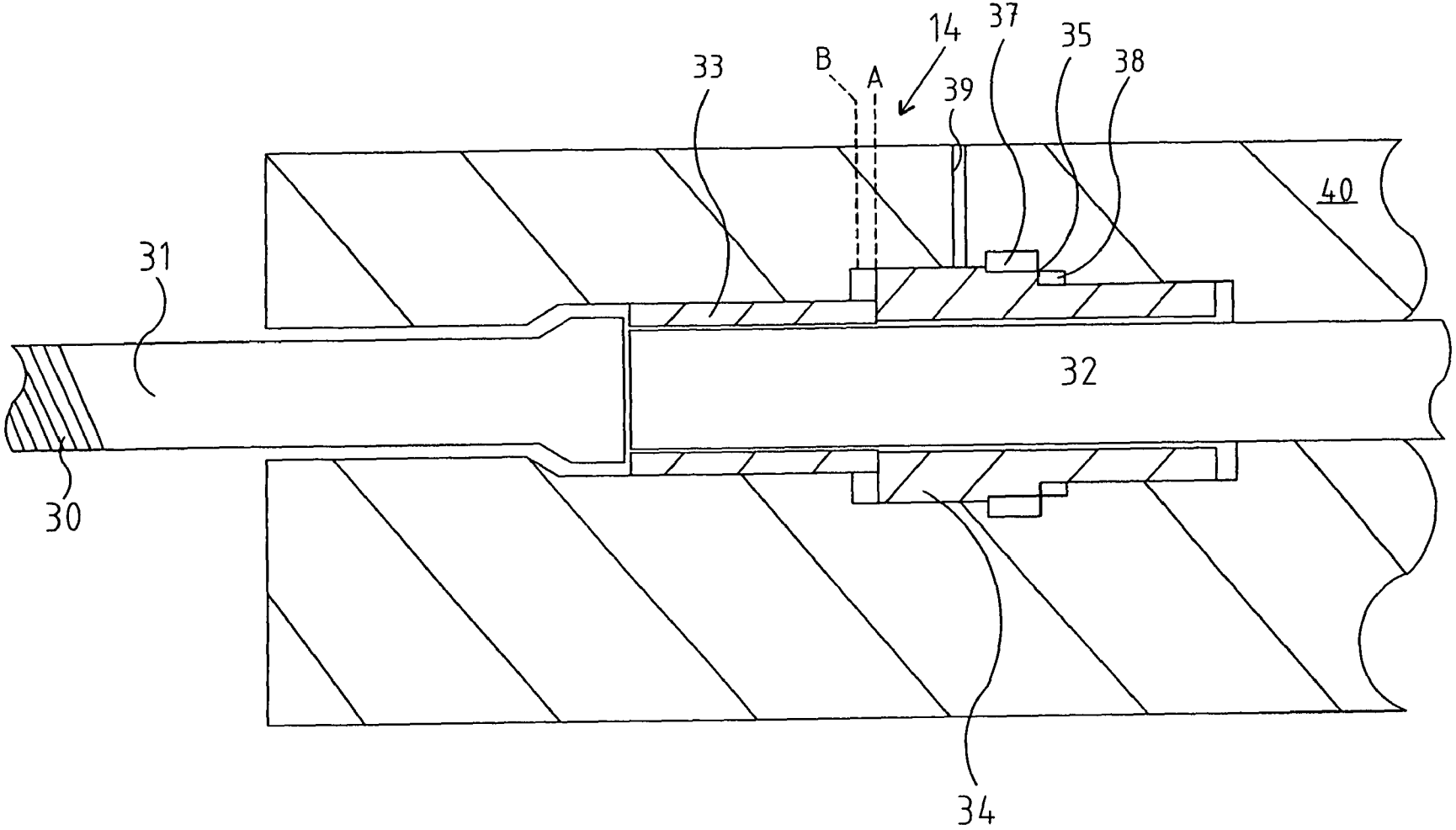
FIG. 2 shows in greater detail the drilling machine arranged on the drilling rig shown in FIG. 1.

FIG. 2 shows the drilling machine 14 in more detail. The drilling machine comprises an adapter 31, one end of which is provided with means 30, for example screw threads, for connection to a drill string component (not shown) in said drill string 15. The drilling machine also comprises a percussion piston 32 which, by impacting against the adapter 31, transmits percussion pulses to the drill string (drill steel) and onwards from there to the rock. The drill string is advanced to the rock via a sleeve 33 with the aid of a damping piston 34, which is arranged in a damping system, which system is also used for damping the percussion pulses that are reflected back from the rock, in a manner that will be explained below. During operation, a force determined by a hydraulic pressure in a first damping chamber 37 is transmitted to the adapter 31 via damping piston 34 and sleeve 33, where said force is used to ensure that the drill bit is kept pressed against the rock at all times. The damping piston is also arranged in such a way that, when it is displaced in the drilling direction relative to a normal position A, for example to a position B, which can occur for example when the drill bit reaches a cavity, or when a harder type of rock merges into a looser type of rock, in which case the impact of the percussion piston "pushes away" the drill string, an outlet 39 is completely or partially freed and creates a decrease in pressure in the first damping chamber 37. In addition to a decrease in pressure being obtained by the outlet 39 being freed, it is also the case that, when the damping piston moves forwards, a degree of leakage occurs between damping piston 34 and housing 40 and affects the pressure in the first damping chamber 37, and, on the whole, the leakage can be such that, at least in an area around the position A, a substantially linear pressure decrease is obtained when the damping piston moves forwards in the drilling direction so that, when the outlet 39 is completely freed, a pressure relief is obtained or a predetermined lowest pressure level, for example level D1 according to FIG. 3 below. By measuring the pressure in the first damping chamber 37 regularly, continuously or at certain intervals (the pressure in the first damping chamber can alternatively be represented by a pressure that is measured/determined in or at a pressure feed line to said first damping chamber 37), the contact of the drill bit with the rock can be determined, and, since a substantially linear pressure decrease can be obtained, it is also possible to determine the position of the damping piston relative to the normal position A, at least until the outlet 39 has been completely freed.

In addition to said function of pressing the drill string against the rock, the damping piston also has a damping function. When an impact gives rise to reflexes from the rock, these are damped by means of the damping piston 34 being pressed into a second damping chamber 38, whereupon fluid in the second damping chamber 38 is pressed into the first damping chamber 37 through a small slit, formed between the damping piston 34 and the chamber wall 35, when the damping piston 34 is pressed into the second damping chamber 38. This results in a braking pressure increase in the second damping chamber 38.

Figure 3:
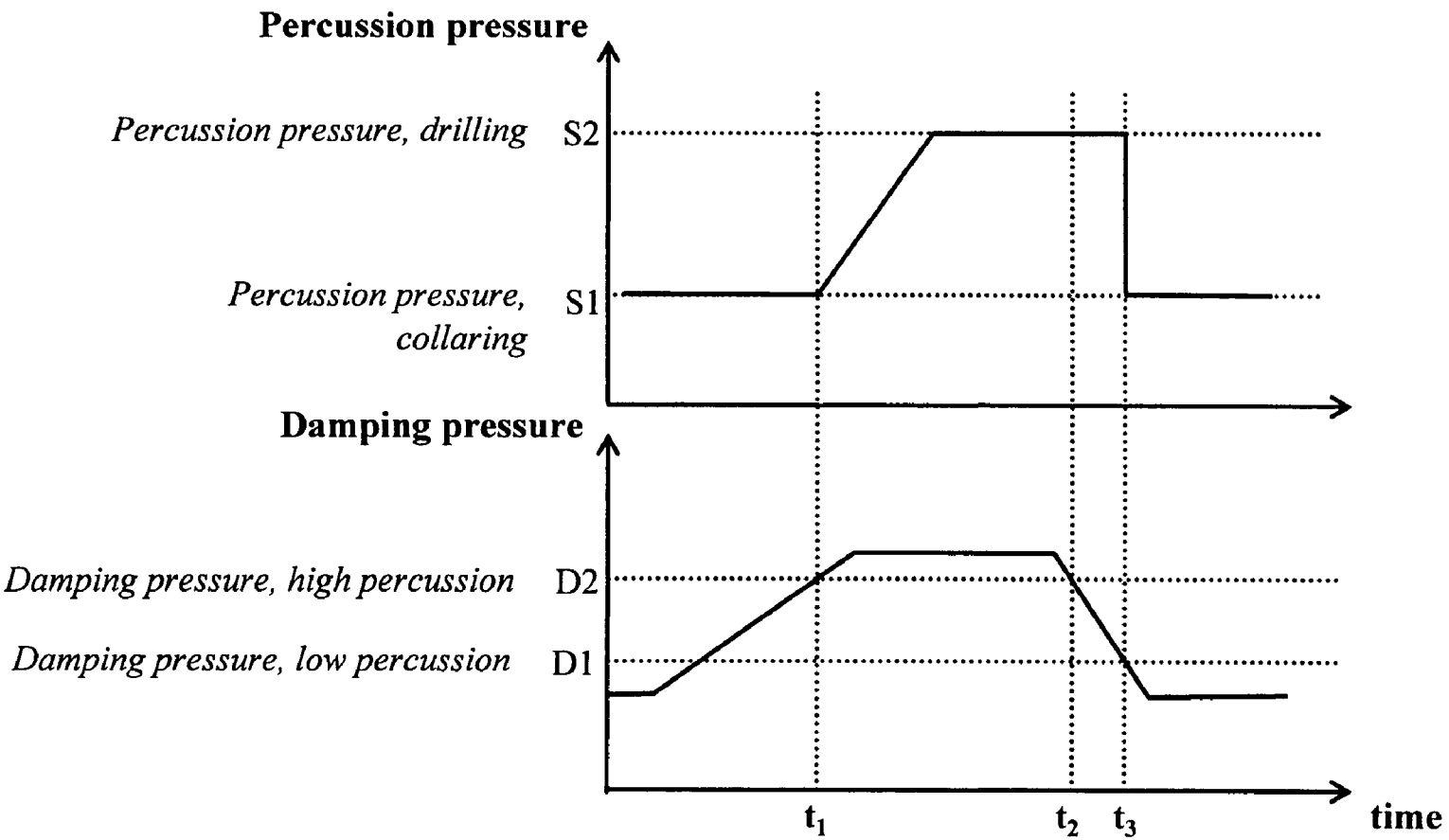
FIG. 3 shows an example of a control of the percussion pressure according to the prior art.

In the prior art, the pressure in said damping chamber 37, or in a feed line to the damping chamber 37, is used to obtain certain control over the percussion pressure of the drilling machine. FIG. 3 shows an example of such control. The known method involves monitoring whether the damping pressure lies at a first level D1, which represents a level where the damping pressure is considered to be low, or a second level D2, which is a level where the damping pressure is considered to be sufficient to allow drilling to be safely performed at full force.

At the start of drilling, the percussion pressure is held at a collaring (start-up drilling) level S1 as long as the damping pressure is below the higher level D2. When the damping pressure at a time t1 exceeds the pressure level D2, the percussion pressure is increased to normal drilling pressure S2, where the percussion pressure is then held as long as the damping pressure dries not fall below the lower pressure level D1. If, at a later time t3, the damping pressure falls below the pressure level D1, the percussion pressure is decreased, as shown, to the start-up drilling level. Alternatively, the percussion pressure can be arranged to be completely shut off if the damping pressure falls below the pressure level D1. However, the control system shown in FIG. 3 has a number of disadvantages.

For example, as is shown, the percussion device can continue impacting at high force despite the fact that contact with the rock is in the process of being lost or is poor, i.e. the damping pressure is below the level D2, for example between the times t2 and t3 in FIG. 3. This means that there is a high risk of idle percussion, especially when the percussion pressure is high and the damping pressure is near the pressure level D1.

The system shown in FIG. 3 also has another disadvantage. There is a risk of the system self-oscillating in the event of a sudden drop in damping pressure to pressure level D1, and the percussion pressure thus being rapidly decreased to the start-up drilling pressure or being completely shut off. This sudden drop in percussion pressure can in turn lead to an increase in the damping pressure, whereupon the percussion pressure is again allowed to increase to normal drilling pressure, and the damping pressure can fall again, and so on.

Figure 4:
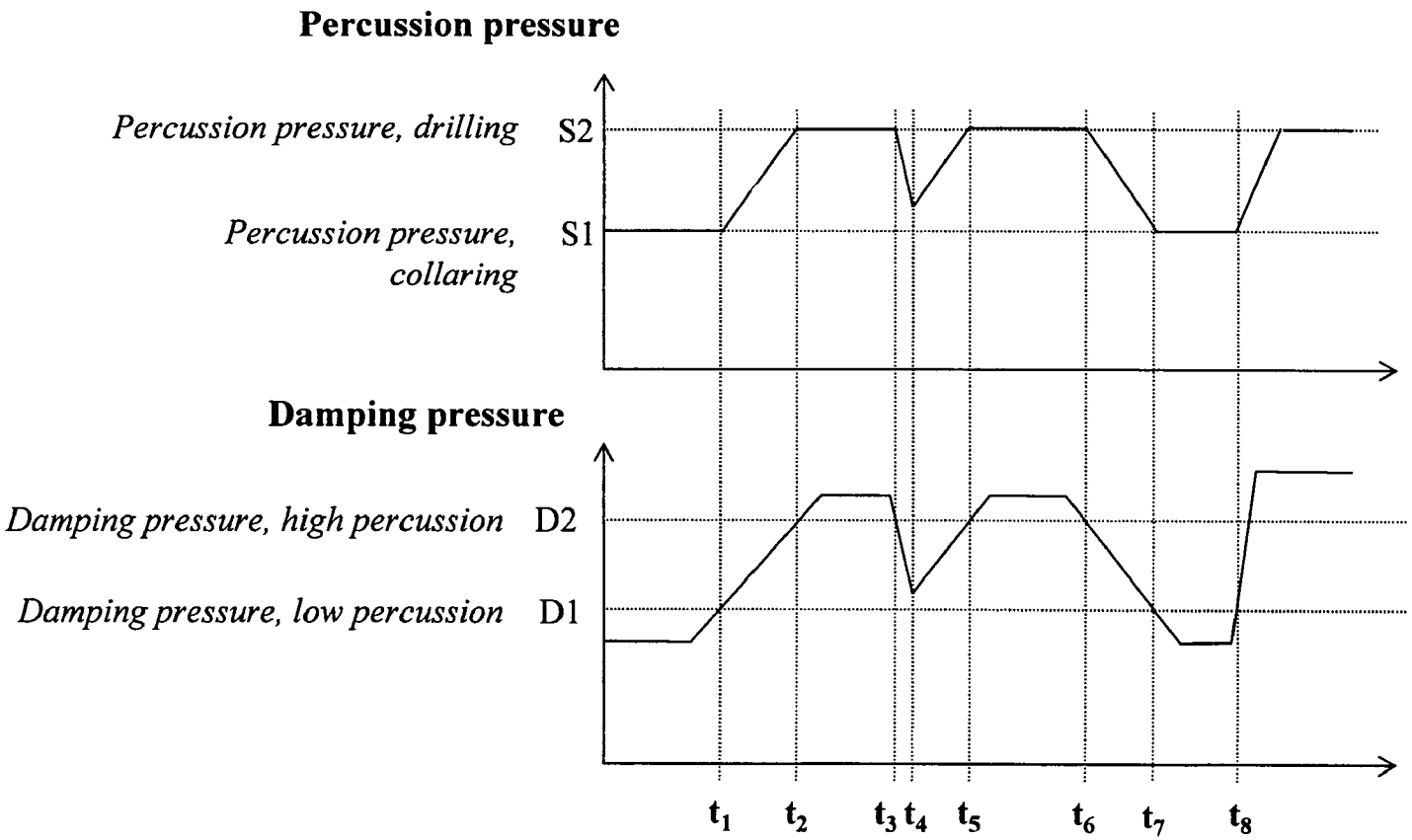
FIG. 4 shows an example of a control of the percussion pressure according to one illustrative embodiment of the present invention.

The present invention at least alleviates the disadvantages of the current systems and will now be described in more detail with reference to FIG. 4. The basic principle of the present invention involves controlling the percussion pressure as a function of the damping pressure, when the damping pressure is, for example, between the damping pressure levels D1 and D2 which are shown in FIG. 3, and which are also indicated in FIG. 4. D1 can be a level at which the percussion pressure should be reduced to the start-up drilling level in order to ensure that the equipment is not damaged, while D2 can be a pressure at which contact with the rock is considered to be good and a high percussion pressure can therefore be accepted. As can be seen in the figure, the percussion pressure, exactly as in the prior art, is maintained at a start-up drilling level as long as the damping pressure does not exceed the level D1. In contrast to the prior art, however, an increase in the percussion pressure begins at t1 as soon as the damping pressure level exceeds the level D1. In this example, the percussion pressure is controlled proportionally to the damping pressure, i.e. if the damping pressure increase is linear, then the percussion pressure increase is also linear. When the damping pressure at t2 then reaches the higher level D2, the percussion pressure is maintained at normal drilling level S2 as long as the damping pressure does not fall below the pressure level D2. When the damping pressure temporarily falls below the level D2 between t3 and t5, the percussion pressure follows the damping pressure proportionally, as can be seen in FIG. 4, and at t5 it again assumes the normal drilling pressure, until the damping pressure again falls below the pressure level D2 at t6, whereupon the percussion pressure again falls proportionally to the damping pressure. If the damping pressure, for example as at t7, is below the pressure level D1, the percussion pressure is decreased to the start-up drilling level, as has been shown and described above. Alternatively, the percussion pressure can be arranged to be decreased to another suitable level or to be completely shut off when the damping pressure falls below the pressure level D1.

FIG. 4 shows a further feature according to one exemplary embodiment of the present invention. For the purpose of relieving the stresses on the components and of reducing the risk of pressure spikes in the hydraulic system, the percussion pressure can be arranged such that it does not increase more quickly than at a defined speed, regardless of how quickly the damping pressure increases, i.e. the percussion pressure increase is controlled in such a way that the percussion pressure increase per unit of time is kept below a threshold value. This is illustrated at t8 where the damping pressure quickly increases to the level for normal drilling, but where the percussion pressure is not allowed to increase as quickly.

The present invention affords a number of advantages. For example, the useful life of the drill bits, drill steel (drill string) and shank adapter is increased. This advantage is obtained by virtue of the harmful reflexes being reduced, since the percussion pressure is already lowered when the damping pressure begins to indicate that the drill bit has poor/worsening contact with the rock. Another advantage of the present invention is that a considerably more sensitive system is obtained, which reduces the risk of the self-oscillation mentioned above.

Figure 5:
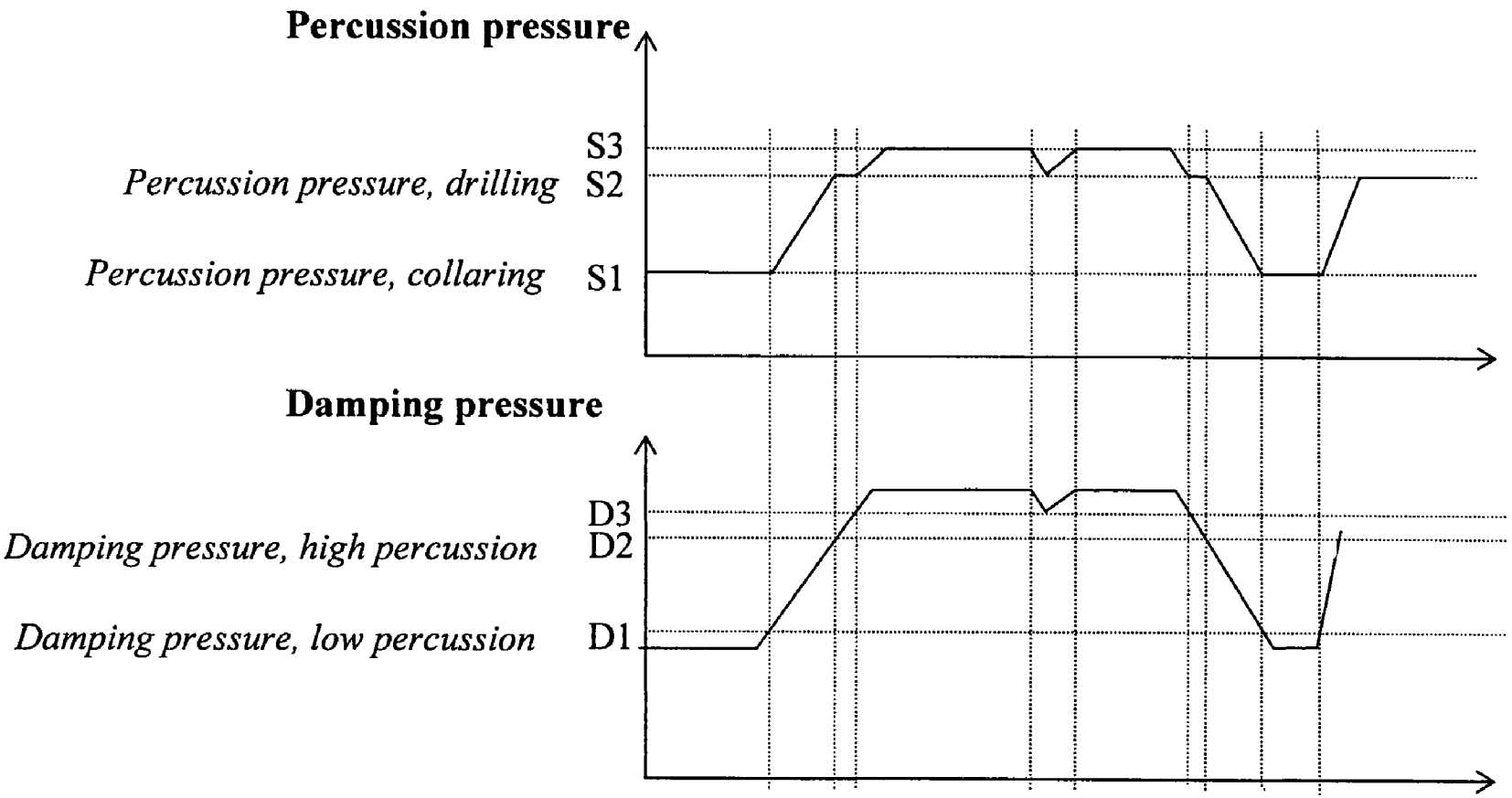
FIG. 5 shows an example of a control of the percussion pressure according to a second illustrative embodiment of the present invention.

FIG. 5 shows another embodiment of the present invention. In addition to the levels D1 and D2 and S1 and S2, there is now a further level S3 for the percussion pressure, this level representing a percussion pressure that is higher than the normal drilling pressure S2. There is also a further level D3 for the damping pressure, this level being slightly above the level D2. When the damping pressure exceeds D3, the percussion pressure can be allowed to increase up to the level S3. In this case for example, as is shown in the figure, the abovementioned control can be used when the damping pressure exceeds D3. As long as the damping pressure lies between D2 and D3, the percussion pressure is maintained at the level S2. Allowing the percussion pressure to exceed the normal drilling pressure has the advantage of facilitating/permitting drilling in cases where, for example, layers of considerably harder rock lie interspersed in the drilled rock. In such situations, it can happen that the percussion pressure S2 in normal drilling is not sufficient to fragment the hard rock. By increasing the percussion pressure in such a situation to a level exceeding the normal pressure, the energy of the emitted shock waves is increased, which means that sections of harder rock can be forced open in this way, after which the percussion pressure can return to normal drilling level when the harder part of the rock has been forced open.

The present invention has been illustrated above in the case of linear control. However, the percussion pressure can of course be controlled also according to any function of the damping pressure. For example, the percussion pressure can be arranged to increase exponentially or logarithmically to the damping pressure. It is advantageous to use a well-known mathematical function that is easy to program in, e.g. into the control unit 16, and which is used for the control. Alternatively, the function can be a table function, i.e. the percussion pressure corresponding to each damping pressure is looked up in a table. Moreover, proportionality constants and exponents (and also factors checked in a table) can be determined at least partially based on the feed rate of the drilling machine, i.e. if the feed rate is high, the proportionality constant/exponent can be set lower, such that the percussion pressure increases more slowly compared with the case when the feed speed is low.

In an alternative embodiment, the percussion pressure is increased in steps, where a certain increase (or decrease) in the damping pressure results in a step up (or down). However, each step is small in relation to the total difference between the first level (S1) and the second level (S2).

As regards the damping pressure in the damping chamber 37, this can be determined as mentioned above, for example by measurement/sensoring by means of a pressure sensor arranged in or near the damping chamber. The damping pressure is determined sufficiently often, for example continuously or at regular intervals, to be able to obtain the variation of the damping pressure at the stroke of the percussion tool, i.e. such that the pressure increase pulses that occur upon reflections from the rock can be detected, after which a mean value of the damping pressure during a percussion cycle can be determined. For example, the pressure sensor can be designed such that it comprises means for calculating said mean value and then, at each percussion cycle, for emitting a representation of the mean value. The pressure sensor can alternatively be designed to emit signals continuously or at certain intervals (depending on the percussion frequency of the drilling machine; a drilling machine operating with a percussion frequency of several hundreds of hertz, or even in the kHz range, requires considerably closer intervals compared with a drilling machine that operates with a percussion frequency of the order of 30-50 Hz), which signals are then used by an external element to determine a mean value of the damping pressure for a percussion cycle. Instead of determining the mean value for one percussion cycle, it is possible to determine the mean value for a plurality of percussion cycles. Instead of measuring the damping pressure in a damping chamber, it is possible, for example, to measure the pressure on the feed line to the damping chamber. This has the advantage that the pressure measurement can take place on the carrier, for example, with reduced routing of cables as a result.

As has been shown above, the present invention can be used both in start-up drilling and normal drilling. The invention is particularly advantageous in conditions where the rock contains numerous fissures and/or the hardness of the rock varies greatly, such that the drill steel occasionally loses contact with the rock ahead, in which case the risk of harmful reflexes can be reduced.

Nor does the control have to take place throughout the interval between start-up drilling level (S1) and normal drilling level (S2), and instead it can be arranged to be carried out only in part of the interval, for example in half this interval, or in that part of the interval where there is greatest risk of contact with the rock being lost.

Furthermore, the present invention has been described in connection with a percussion drilling machine that comprises a percussion piston, where the energy of the percussion pulse in principle consists of the kinetic energy of the percussion piston, which energy is transmitted to the drill steel. However, the present invention can also be used with other types of pulse-generating devices, for example devices in which the shock-wave energy is instead generated as pressure pulses that are transmitted to the drill string from an energy storage through a impact means that executes only a very small movement. In these types of impulse-generating devices too, a damping pressure can be measured in a damping chamber, which can in fact be any chamber, as long as the desired damping function is achieved.

As will be readily appreciated, although it will still be mentioned here for the sake of clarity, the expression "control of a pressure as a function of another pressure", as used according to the present invention, does not include the type of control in which the percussion pressure is suddenly reduced from the normal drilling pressure to, for example, the start-up drilling pressure as soon as the damping pressure passes a threshold value.

The invention claimed is:

1. Method for controlling at least one drill parameter when drilling rock with a drilling machine, in which method, during drilling, an impulse-generating device by means of an impact means induce shock waves in a tool working against the rock, wherein a pressure level for a shock-wave-generating pressure is controlled during the drilling, said drilling machine including a damping chamber that can be pressurized, and the control of the contact of the drilling machine against the rock is affected at least partially by the pressure prevailing in said damping chamber, characterized by the step in which, when the pressure in said damping chamber exceeds a first level and is below a second level, the percussion pressure is controlled as a function of a pressure in said damping chamber.

2. Method according to claim 1, characterized in that said control involves the percussion pressure being controlled between a first level, which substantially corresponds to a start-up drilling level, and a second level, which substantially corresponds to a normal drilling level.

3. Method according to claim 1, characterized in that it further includes the step of, during said control, increasing the percussion pressure when the pressure in said damping chamber increases, and decreasing the percussion pressure when the pressure in said damping chamber decreases.

4. Method according to claim 1, characterized in that a percussion pressure increase is controlled in such a way that the percussion pressure increase per unit of time is kept below a threshold value.

5. Device for controlling at least one drill parameter when drilling in rock with a drilling machine, where, during drilling, an impulse-generating device, by means of an impact means induce shock waves in a tool working against the rock, wherein a pressure level for a shock-wave-generating pressure is controlled during the drilling, said drilling machine including a damping chamber that can be pressurized, and the control of the contact of the drilling machine against the rock being affected at least partially by the pressure prevailing in said damping chamber, characterized in that the device includes means for, when the pressure in said damping chamber exceeds a first level and is below a second level, controlling a percussion pressure as a function of the pressure in said damping chamber.

6. Device according to claim 5, characterized in that, during said control, the said means are arranged to control the percussion pressure between a first level, which substantially corresponds to a start-up

7. Device according to claim 6, characterized in that said means is arranged to control the percussion pressure in such a way that the control reflects changes in the pressure in said damping chamber.

8. Device according to claim 6, characterized in that it further includes means for, when the pressure in said damping chamber exceeds said second level, controlling the percussion pressure in such a way that it is maintained substantially at a pressure corresponding to the percussion pressure for said second level.

9. Device according to claim 6, characterized in that said means are arranged to determine said pressure in said damping chamber by determining a parameter value representing a mean value of a damping pressure in the damping chamber.

10. Device according to claim 5, characterized in that said means is arranged to control the percussion pressure in such a way that the control reflects changes in the pressure in said damping chamber.

11. Device according to claim 10, characterized in that it further includes means for, when the pressure in said damping chamber exceeds said second level, controlling the percussion pressure in such a way that it is maintained substantially at a pressure corresponding to the percussion pressure for said second level.

12. Device according to claim 7, characterized in that said means are arranged to determine said pressure in said damping chamber by determining a parameter value representing a mean value of the damping pressure in the damping chamber.

13. Device according to claim 5, characterized in that it further includes means for, during said control, increasing the percussion pressure with an increase of the pressure in said damping chamber, and decreasing the percussion pressure with a decrease of the pressure in said damping chamber.

14. Device according to claim 5, characterized in that it further includes means for, when the pressure in said damping chamber exceeds said second level, controlling the percussion pressure in such a way that it is maintained substantially at the pressure corresponding to the percussion pressure for said second level.

15. Device according to claim 5, characterized in that said means are arranged to control a percussion pressure increase in such a way that the percussion pressure increase per unit of time is maintained below a threshold value.

16. Device according to claim 5, characterized in that said means are arranged to determine said pressure in said damping chamber by determining a parameter value representing a mean value of a damping pressure in the damping chamber.

17. Device according to claim 16, in which said means are arranged to determine said mean value based on a number of impulse cycles.

18. Device according to claim 5, characterized in that it further includes means for, when the pressure in said damping chamber exceeds a third level higher than said second level, controlling the percussion pressure as a function of the pressure in said damping chamber, with said percussion pressure exceeding a second percussion pressure level.

19. Device according to claim 5, characterized in that it further includes means for controlling the percussion pressure in such a way that the time for an increase of said percussion pressure from a first level to a second level exceeds a threshold value.

20. Rock-drilling rig, characterized in that it includes a device According to claim 5.

* * * * *

UNITED STATES PATENT AND TRADEMARK OFFICE

CERTIFICATE OF CORRECTION

PATENT NO. : 8,365,840 B2
APPLICATION NO. : 12/450686
DATED : February 5, 2013
INVENTOR(S) : Jonas Sinnerstad et al.

It is certified that error appears in the above-identified patent and that said Letters Patent is hereby corrected as shown below:

Claim 6 is revised as follows:

--Device according to claim 5, characterized in that, during said control, the said means are arranged to control the percussion pressure between a first level, which substantially corresponds to a start-up drilling level, and a second level, which substantially corresponds to a normal drilling level.--

Signed and Sealed this
Twelfth Day of March, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,365,840 B2
APPLICATION NO. : 12/450686
DATED : February 5, 2013
INVENTOR(S) : Jonas Sinnerstad et al.

It is certified that error appears in the above-identified patent and that said Letters Patent is hereby corrected as shown below:

Column 8, line 46-49, Claim 6 is revised as follows:

--Device according to claim 5, characterized in that, during said control, the said means are arranged to control the percussion pressure between a first level, which substantially corresponds to a start-up drilling level, and a second level, which substantially corresponds to a normal drilling level.--

This certificate supersedes the Certificate of Correction issued March 12, 2013.

Signed and Sealed this
Ninth Day of April, 2013

Teresa Stanek Rea
*Acting Director of the United States Patent and Trademark Office*